US007744052B2

(12) United States Patent
Wooten

(10) Patent No.: US 7,744,052 B2
(45) Date of Patent: Jun. 29, 2010

(54) SHELF BRACKET AND METHOD OF MAKING SAME

(75) Inventor: Donald W. Wooten, Arlington, TX (US)

(73) Assignee: Wooten Metal, Inc., Dallas, TX (US)

( * ) Notice: Subject to any disclaimer, the term of this patent is extended or adjusted under 35 U.S.C. 154(b) by 142 days.

(21) Appl. No.: 12/152,985

(22) Filed: May 19, 2008

(65) Prior Publication Data

US 2008/0217496 A1 Sep. 11, 2008

Related U.S. Application Data

(63) Continuation-in-part of application No. 11/269,010, filed on Nov. 8, 2005.

(60) Provisional application No. 60/643,939, filed on Jan. 14, 2005.

(51) Int. Cl.
*A47G 29/02* (2006.01)

(52) U.S. Cl. ..... 248/248; 248/220.1; 248/903; 248/909

(58) Field of Classification Search ..... 248/248, 248/300, 216.4, 217.1, 217.3, 903, 909, 220.1; 403/231, 205, 403
See application file for complete search history.

(56) References Cited

U.S. PATENT DOCUMENTS

| | | | |
|---|---|---|---|
| 2,739,777 | A | 3/1956 | Schoenhardt |
| 2,845,187 | A | 7/1958 | Bianchi |
| 3,041,033 | A | 6/1962 | Schwartz |
| 4,313,587 | A | 2/1982 | Loeschen |
| 4,804,159 | A | 2/1989 | Martel |
| 5,318,264 | A | 6/1994 | Meiste |
| 5,364,052 | A | 11/1994 | De Gruttis |
| 5,531,052 | A | 7/1996 | Agar |
| 5,797,694 | A | 8/1998 | Breivik |

OTHER PUBLICATIONS

Bitzel et al., The Fascinating World of Sheet Metal, p. 18, 2nd ed. 1996.

*Primary Examiner*—Korie Chan

(57) ABSTRACT

A blank for forming a corner shelf bracket having a ledge and a plurality of side members. The blank has a first side portion and a second side portion, which can be bent to create the side members. The blank also has a third side portion created within either the first side portion or the second side portion which can be bent outwardly relative to the first side portion and the second side portion to attach to perpendicular faces of a corner stud support. In addition, the blank has a ledge portion for supporting a load when the blank is converted into a corner shelf bracket and a lip portion which can be bent to form a retaining member. The blank also has a plurality of stiffener portions which can be bent to create added stability when the blank is converted into the corner shelf bracket and attached to the corner stud support. The side portions, lip portion, stiffener portions and the ledge portion of the blank are all connected to the blank by a plurality of stress lines to facilitate bending of the blank into the corner shelf bracket. Connected to each of the stiffener portions are connector portions which connect to the corner stud support for added strength when the blank is converted into a shelf bracket. The blank also contains one or more ribs in the side portions and in the ledge portion to provide strength to the corner shelf bracket.

7 Claims, 8 Drawing Sheets

SHELF BRACKET AND METHOD OF MAKING SAME

CROSS REFERENCE TO RELATED APPLICATIONS

The present application is a continuation-in-part of the nonprovisional patent application identified by U.S. Ser. No. 11/269,010, filed on Nov. 8, 2005, which claims priority to the provisional patent application identified by U.S. Ser. No. 60/643,939, filed on Jan. 14, 2005, the entire contents of both are hereby incorporated herein by reference.

STATEMENT REGARDING FEDERALLY SPONSORED RESEARCH OR DEVELOPMENT

Not applicable.

DETAILED DESCRIPTION OF THE PREFERRED EMBODIMENT OF THE INVENTION

Figure 1:
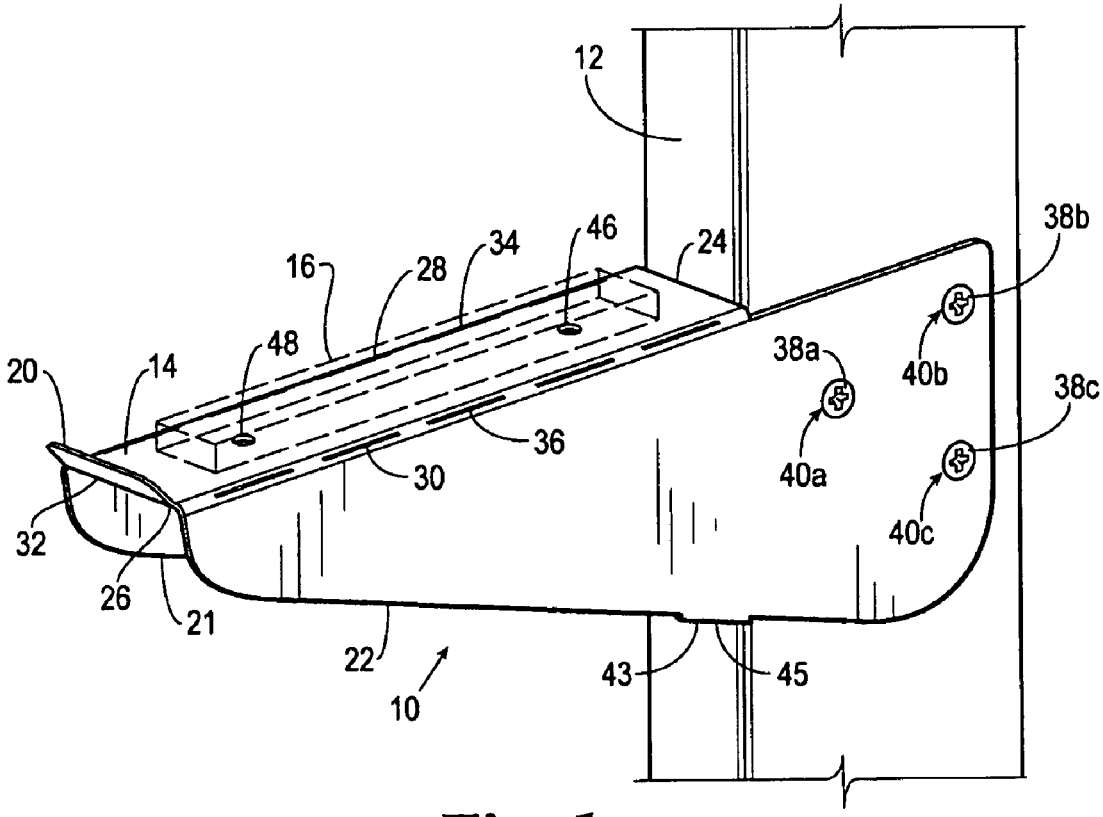
FIG. 1 is a perspective view of a shelf bracket, constructed in accordance with the present invention, connected to a support.
Figure 2:
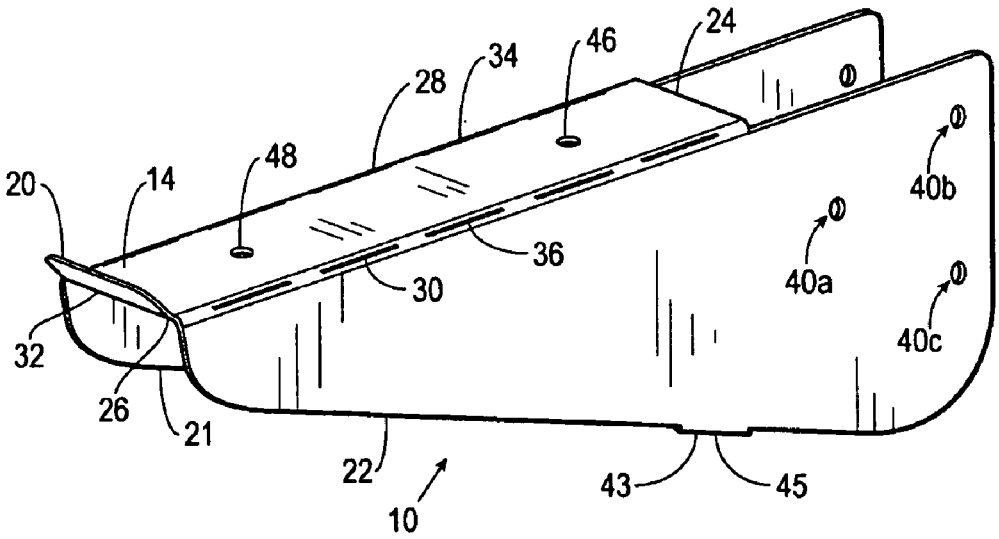
FIG. 2 is a perspective view of the shelf bracket depicted in FIG. 1.

Referring now to the drawings, and in particular to FIGS. 1-2, shown therein and designated by a reference numeral 10 is a shelf bracket. The shelf bracket 10 is connected to a support 12 (shown in FIG. 1) such that a ledge 14 of the shelf bracket 10 is capable of supporting a load 16 (shown in FIG. 1). The support 12 can be any type of post, or vertical support capable of supporting the shelf bracket 10. For example, the support 12 can be a 2×4 stud utilized commonly in the building construction industry, particularly in barns and sheds where additional storage capacity is desirable. The load 16 can be anything capable of being supported by the shelf bracket 10. For example, it is envisioned that more than one of the shelf bracket 10 will be utilized for forming a shelving unit (not shown). In this case, at least two of the shelf brackets 10 would be utilized with the shelf brackets 10 being spaced a distance laterally apart. In this instance, the load 16 will commonly include a shelf which is positioned upon the ledges 14 upon which other types of loads, such as paint cans, coolers, books, or the like will be stored.

The shelf bracket 10 is also provided with a lip 20, and a pair of side members 21 and 22. The ledge 14 is provided with a first end 24, a second end 26, a first side 28, and a second side 30. The lip 20 is connected to the second end 26 of the ledge 14, and extends a distance therefrom. The lip 20 is preferably separated from the ledge 14 via a stress line 32 extending between the lip 20 and the ledge 14. The side member 21 is connected to the first side 28 of the ledge 14, and extends a distance downwardly therefrom generally at an angle of about 90°. In a similar manner, the side member 22 is connected to the second side 30 of the ledge 14 and also extends downwardly therefrom at an angle of about 90°. The side member 21, and the side member 22 are separated from the ledge 14 via stress lines 34 and 36. The stress lines 32, 34 and 36 form weakened linear areas within the shelf bracket 10 and can be formed by any suitable method, such as a series of round holes, a series of slots, or a laser cutline. Shown by way of example in FIG. 1 are the stress lines 32, 34 and 36 being formed from a series of slots.

The side members 21 and 22 extend past the first end 24 of the ledge 14 so as to form a cavity into which the support 12 is positioned. The first end 24 of the ledge 14 engages the support 12 when the shelf bracket 10 is installed on the support 12, and the side members 21 and 22 wrap around the support 12 so that the side members 21 and 22 can engage the support 12. For example, as shown in FIG. 1, the side members 21 and 22 can be connected to the support 12 by a plurality of fasteners 38 (the fasteners 38 are designated as 38*a*, 38*b* and 38*c* for purposes of clarity) positioned through a plurality of openings 40 (the openings 40 are designated as 40*a*, 40*b* and 40*c* for purposes of clarity) and secured to the support 12.

Figure 3:
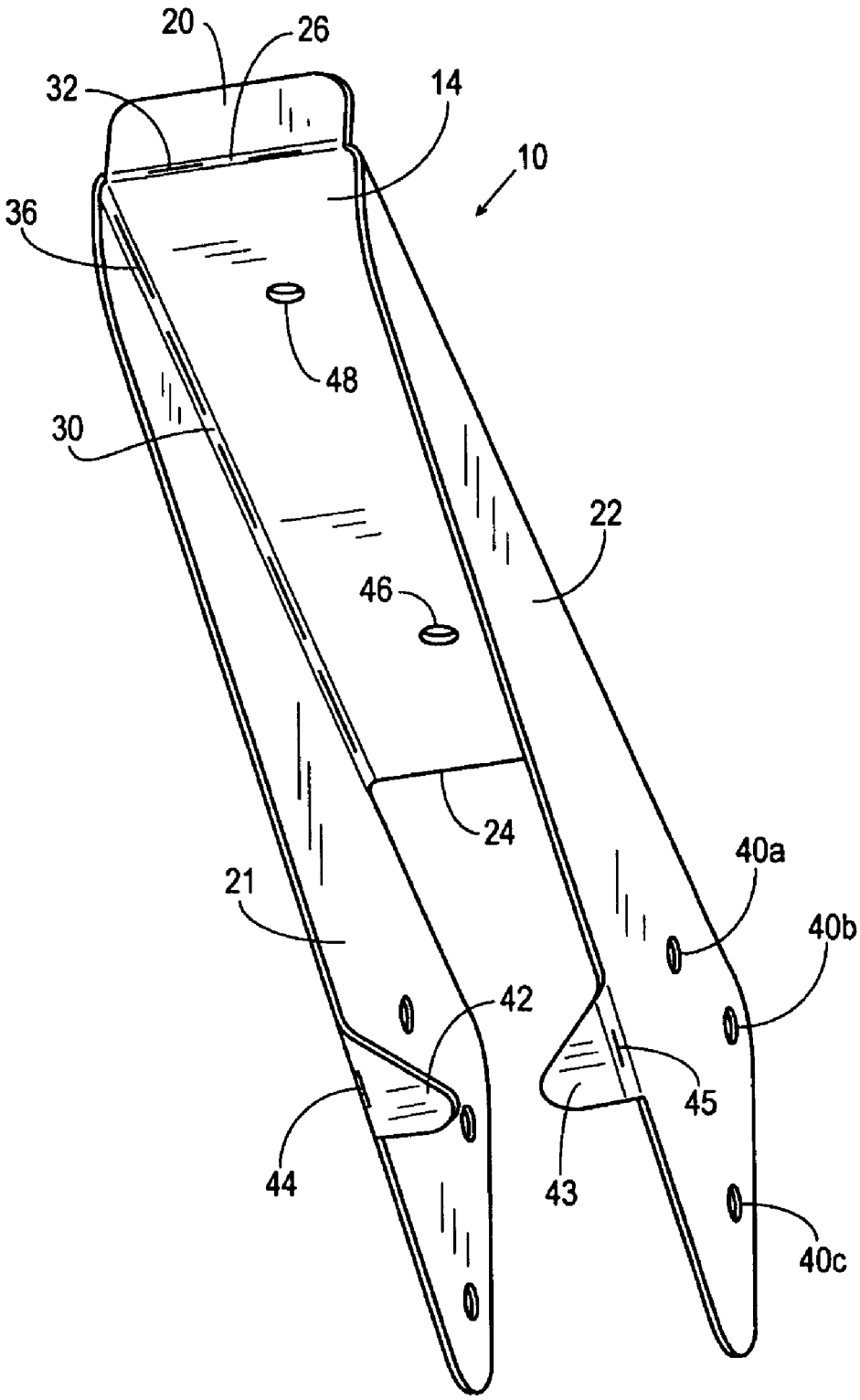
FIG. 3 is another perspective view of the shelf bracket depicted in FIG. 1, showing an underside of the shelf bracket.

To stabilize the shelf bracket 10 on the support 12, the shelf bracket 10 is provided with a pair of stiffeners 42 (shown in FIG. 3) and 43. The stiffeners 42 and 43 are connected to and extend inwardly from the side members 21 and 22. The stiffeners 42 and 43 are preferably separated from the side members 21 and 22 via stress lines 44 and 45 extending between the stiffeners 42 and 43 and the side members 21 and 22. The stiffeners 42 and 43 engage the support 12 to prevent downward rotation of the shelf bracket 10 on the support 12. The stiffeners 42 and 43 are aligned with the first end 24 of the ledge 14 so that when the stiffeners 42 and 43, and first end 24 of the ledge 14 are positioned against the support 12 the ledge 14 extends generally 90° away from the support 12.

To secure the load 16 on the ledge 14, the shelf bracket 10 can be provided with any suitable assembly. For example, the shelf bracket 10 can be provided with openings 46 and 48 extending through the ledge 14 so that a fastener, such as a screw can be inserted through the openings 46 and 48 and secured to the load 16.

Figure 4:
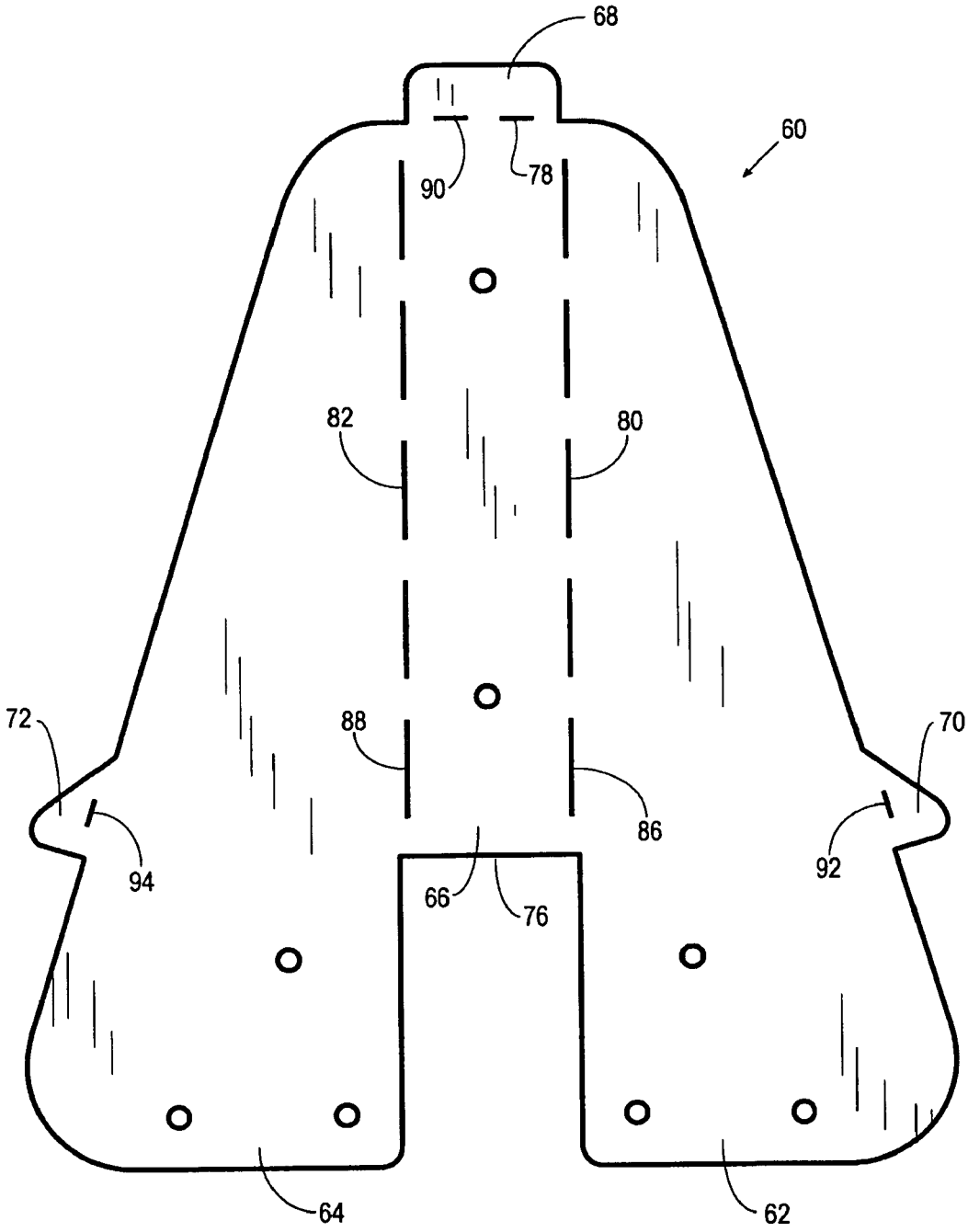
FIG. 4 is a top plan view of a blank utilized for forming the shelf bracket depicted in FIG. 1.
Figure 5:
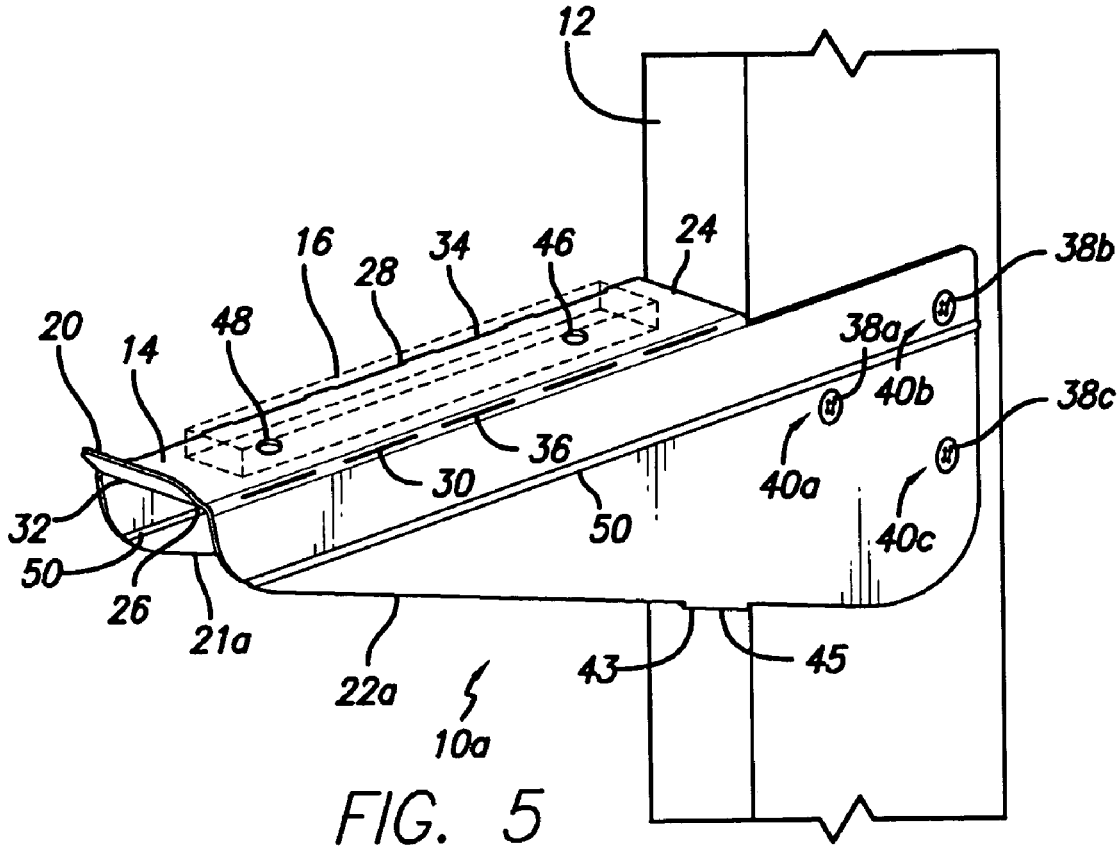
FIG. 5 is a perspective view of another shelf bracket constructed in accordance with the present invention having one or more rib formed in side members to provide the shelf bracket with additional strength.
Figure 6:
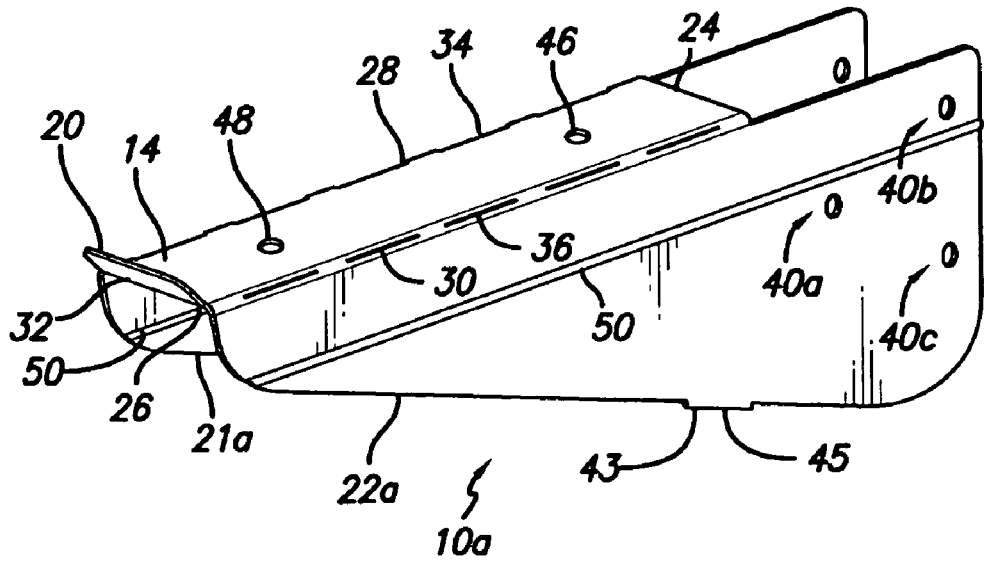
FIG. 6 is a perspective view of the shelf bracket of FIG. 5.
Figure 7:
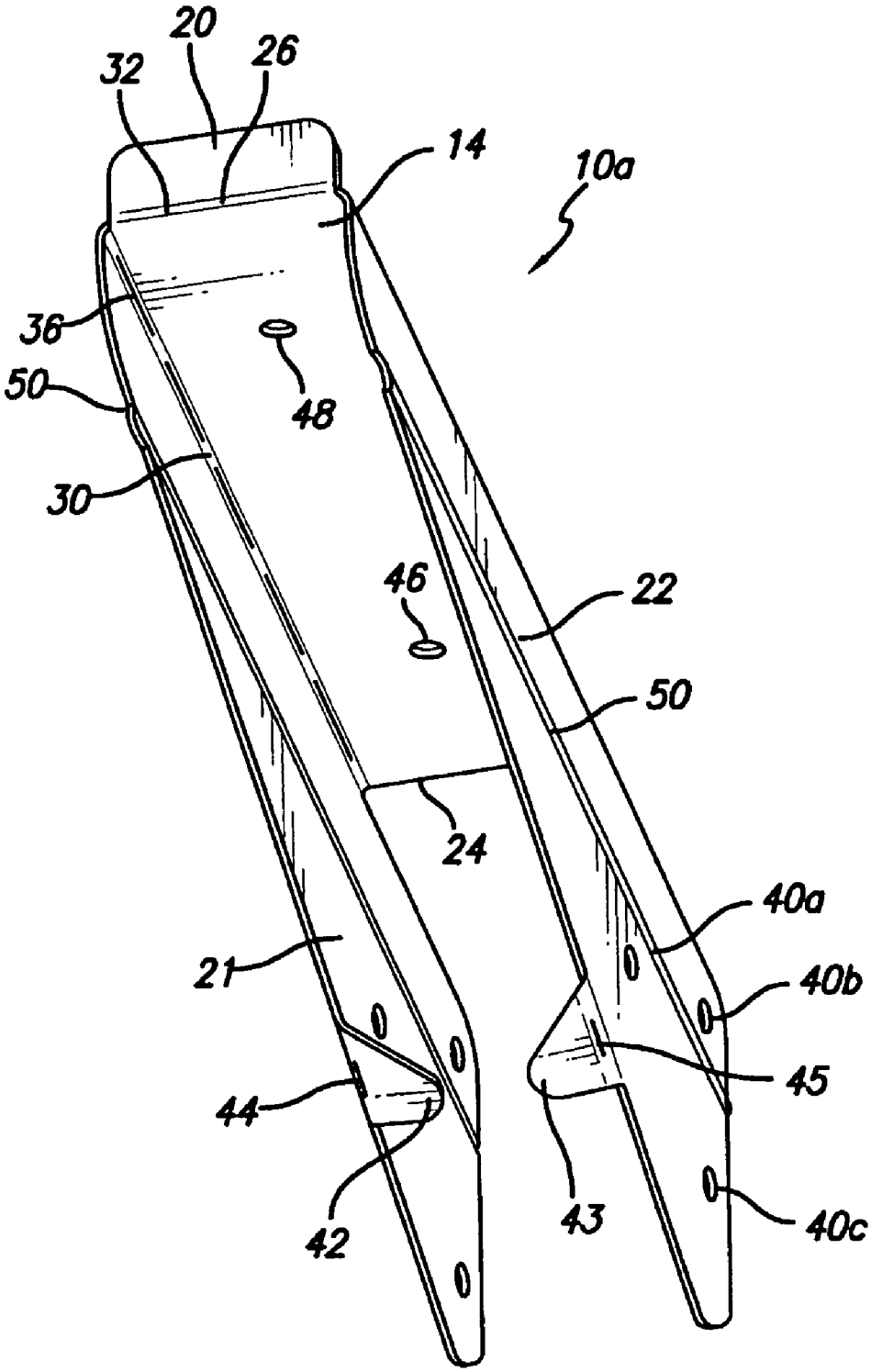
FIG. 7 is another perspective view of the shelf bracket of FIG. 5, showing an underside of the shelf bracket.

Referring now to FIG. 4, shown therein is a blank 60 which can be utilized for forming the shelf bracket 10. The blank 60 is preferably constructed of a single sheet of material. The thickness, and/or construction of the material will vary based upon the desired use of the shelf bracket 10. For example, where the shelf bracket 10 will be utilized at an individual's home for supporting rather small loads 16, such as paint cans, the blank 60 can be constructed of a material such as 18-22 gauge steel.

The blank 60 is provided with a substantially triangular shape. However, it should be understood that the blank 60 can be provided with any shape so long as the blank 60 can be utilized as described herein. The blank 60 defines a first side portion 62, a second side portion 64, a ledge portion 66, a lip portion 68, a first stiffener portion 70, and a second stiffener portion 72.

The ledge portion 66 is provided with a first end 76, a second end 78, a first side 80, and a second side 82. The first side portion 62 borders the first side 80 of the ledge portion 66, and is separated therefrom by way of a stress line 86. The second side portion 64 borders the second side 82 of the ledge portion 66 and is separated therefrom by way of a stress line 88. The lip portion 68 borders the second end 78 of the ledge portion 66 and is separated therefrom by way of a stress line 90. The first stiffener portion 70 borders an outer side of the first side portion 62 and is separated therefrom by way of a stress line 92. The second stiffener portion 72 borders an outer side of the second side portion 64 and is separated therefrom by way of a stress line 94. The stress lines 86, 88, 90, 92 and 94 can be formed from any suitable process for weakening the blank 60 in these areas. For example, the stress lines 86, 88, 90, 92 and 94 can be formed by a series of circular cut outs, slots, or laser cutline.

The blank 60 can be formed from any suitable process. For example, the blank 60 can be formed by stamping, laser cutting, water jet cutting, or the like.

To form the shelf bracket 10 from the blank 60, the first side portion 62, and the second side portion 64 are bent approximately 90° with respect to the ledge portion 66 so that the first side portion 62 forms the side member 21, and the second side portion 64 forms the side member 22. The ledge portion 66 of the blank 60 forms the ledge 14 of the shelf bracket 10.

To prevent the load 16 from falling off of the ledge 14, the lip portion 68 can be bent upwardly, in a direction generally opposite the direction in which the first side portion 62 and the second side portion 64 have been bent. Additionally, the first stiffener portion 70, and the second stiffener portion 72 can be bent inwardly to form the stiffeners 42 and 43 depicted in FIG. 3.

It should be understood that the blank 60 is designed to be bent into the shelf bracket 10 by an individual using tools normally owned by a homeowner. Thus, it should be understood that the blank 60 can be bent using either the hands of the individual, a small hand-operated tool, such as a pair of pliers or a hammer, or perhaps a homeowner's shop vise.

Referring now to FIGS. 5-8, shown therein is another version of a shelf bracket designated as 10*a* and a blank designated as 60*a*. The shelf bracket 10*a* is similar in construction and function to the shelf bracket 10 described above with reference to FIGS. 1-4 respectively. The blank 60*a* is similar in construction and function to the blank 60 described above with reference to FIGS. 1-4 respectively. The common features between the shelf bracket 10*a* and the shelf bracket 10 and the blank 60*a* and 60 will not be described hereinafter for purposes of brevity. However, the common features will be labeled in FIGS. 5-8 with the same numeric prefix followed by an "a" alphabetic suffix.

The shelf bracket 10*a* is provided with a pair of side members 21*a* and 22*a* having at least one rib 50 formed in each of the side members 21*a* and 22*a*. The ribs 50 provide additional strength to the side members 21*a* and 22*a* so that a thinner material can be used in forming the side members 21*a* and 22*a*. Although only one rib 50 is shown in each of the side members 21*a* and 22*a*, it should be understood that more than one rib 50 can be provided in each of the side members 21*a* and 22*a* to provide for even additional strength. The more than one rib 50 in each of the side members 21*a* and 22*a* can be either spaced apart, or contiguous.

Although the rib 50 is shown as extending generally across the entire side member 21*a*, it should be understood that the rib 50 can extend only partially across the side member 21*a*. Further, multiple ribs 50 can be positioned in certain areas of the side members 21*a* so as to increase the strength in such areas, while other areas of the side members 21*a* could be devoid of such ribs 50.

Furthermore, although the ribs 50 are shown as extending generally parallel to the ledge portion of the shelf bracket 10*a*, it should be understood that the ribs 50 can extend at any desirable angle or orientation with respect to the ledge portion of the shelf bracket 10*a*.

The ribs 50 can form a "u" or a "v" cross-sectional shape on the side members 21*a* and 22*a* of the shelf bracket 10. However, it should be understood that the rib 50 may have any shape and be in any location on the shelf bracket 10*a*.

Figure 8:
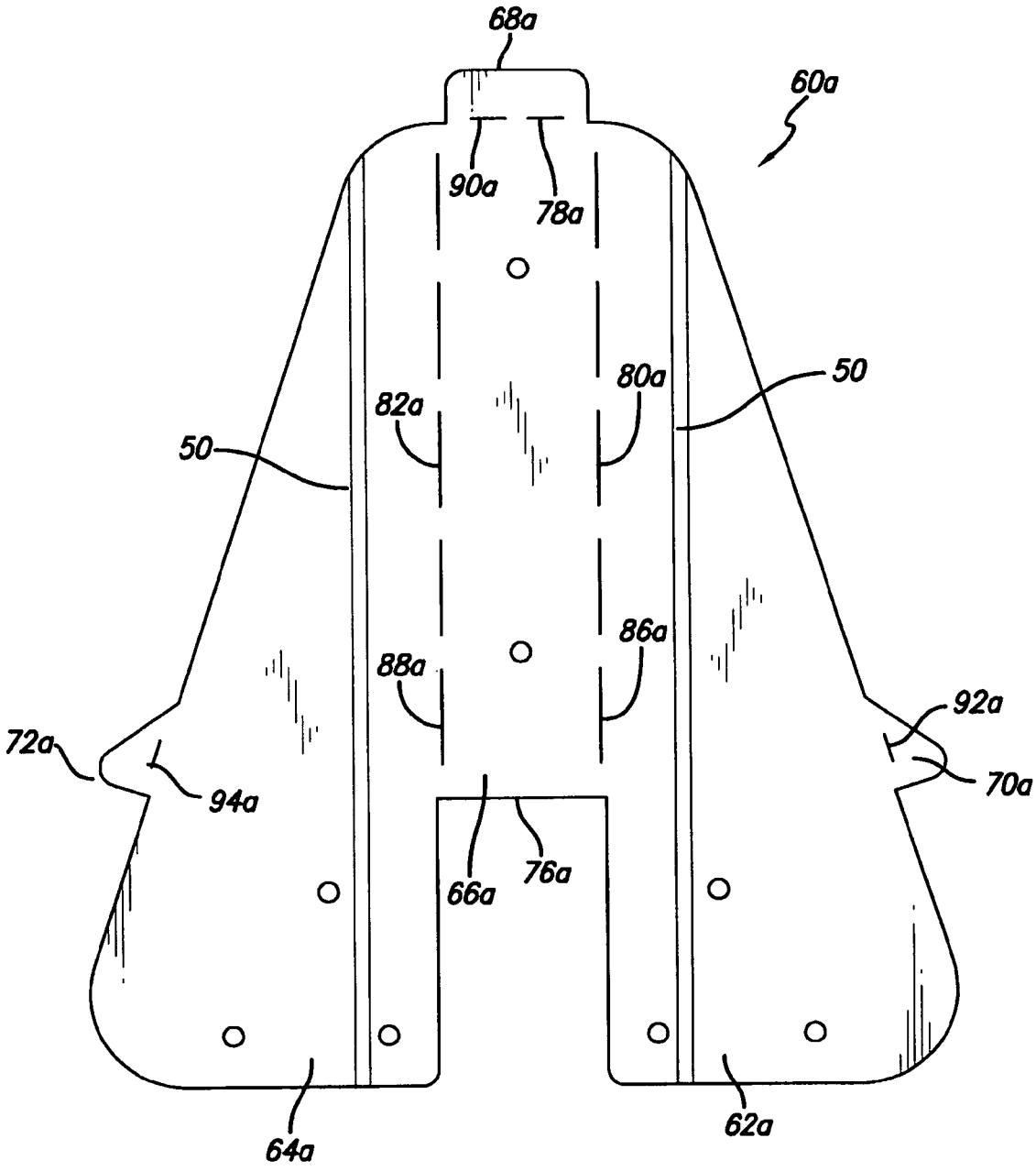
FIG. 8 is a top plan view of a blank utilized for forming the shelf bracket depicted in FIG. 5.

Referring now to FIG. 8, shown therein is a blank 60*a* which can be utilized for forming the shelf bracket 10*a*. The blank 60*a* is preferably constructed of a single sheet of material. The thickness, and/or construction of the material will vary based upon the desired use of the shelf bracket 10*a*. For example, where the shelf bracket 10*a* will be utilized at an individual's home for supporting rather small loads 16, such as paint cans, the blank 60*a* can be constructed of a material such as 18-30 gauge steel or other light gauge material. Thus, it should be understood that the blank 60*a* can be bent using either the hands of the individual, a small hand-operated tool, such as a pair of pliers or a hammer, or perhaps a homeowner's shop vise.

The blank 60*a* is provided with a substantially triangular shape. However, it should be understood that the blank 60*a* can be provided with any shape so long as the blank 60*a* can be utilized as described herein. The blank 60*a* defines a first side portion 62*a*, a second side portion 64*a*, a ledge portion 66*a*, a lip portion 68*a*, a first stiffener portion 70*a*, and a second stiffener portion 72*a*.

The ledge portion 66*a* is provided with a first end 76*a*, a second end 78*a*, a first side 80*a*, and a second side 82*a*. The first side portion 62*a* borders the first side 80*a* of the ledge portion 66*a*, and is separated therefrom by way of a stress line 86*a*. The second side portion 64*a* borders the second side 82*a* of the ledge portion 66*a* and is separated therefrom by way of a stress line 88*a*. The lip portion 68*a* borders the second end 78*a* of the ledge portion 66*a* and is separated therefrom by way of a stress line 90*a*. The first stiffener portion 70*a* borders an outer side of the first side portion 62*a* and is separated therefrom by way of a stress line 92*a*. The second stiffener portion 72*a* borders an outer side of the second side portion 64*a* and is separated therefrom by way of a stress line 94*a*. The stress lines 86*a*, 88*a*, 90*a*, 92*a* and 94*a* can be formed from any suitable process for weakening the blank 60*a* in these areas. For example, the stress lines 86*a*, 88*a*, 90*a*, 92*a* and 94*a* can be formed by a series of circular cut outs, slots, or laser cutline(s).

The blank 60*a* is also provided with at least two rib portions 50 which form the ribs 50 when the blank 60*a* is formed into the shelf bracket 10*a*. Each of the rib portions 50 extending across or inside one the first side portion 62*a*, or the second side portion 64*a*. The rib portions 50 provide additional strength to the side members 21*a* and 22*a* when the blank 60*a* is formed into the shelf bracket 10*a* so that a thinner material can be used in forming blank 60*a*. This reduces the cost of the blank 60*a*. Although only one rib portion 50 is shown in each of the side portions 62*a* and 64*a*, it should be understood that more than one rib portion 50 can be provided in each of the side portions 62*a* and 64*a* to provide for even additional strength. The more than one rib portion 50 in each of the side portions 62*a* and 64*a* can be either spaced apart, or contiguous.

The blank 60*a* can be formed from any suitable process. For example, the blank 60*a* can be formed by stamping, laser cutting, water jet cutting, extrusion, molding or the like. The rib portion 50 can be formed by any suitable method, such as embossing, or stamping or the like.

Figure 9:
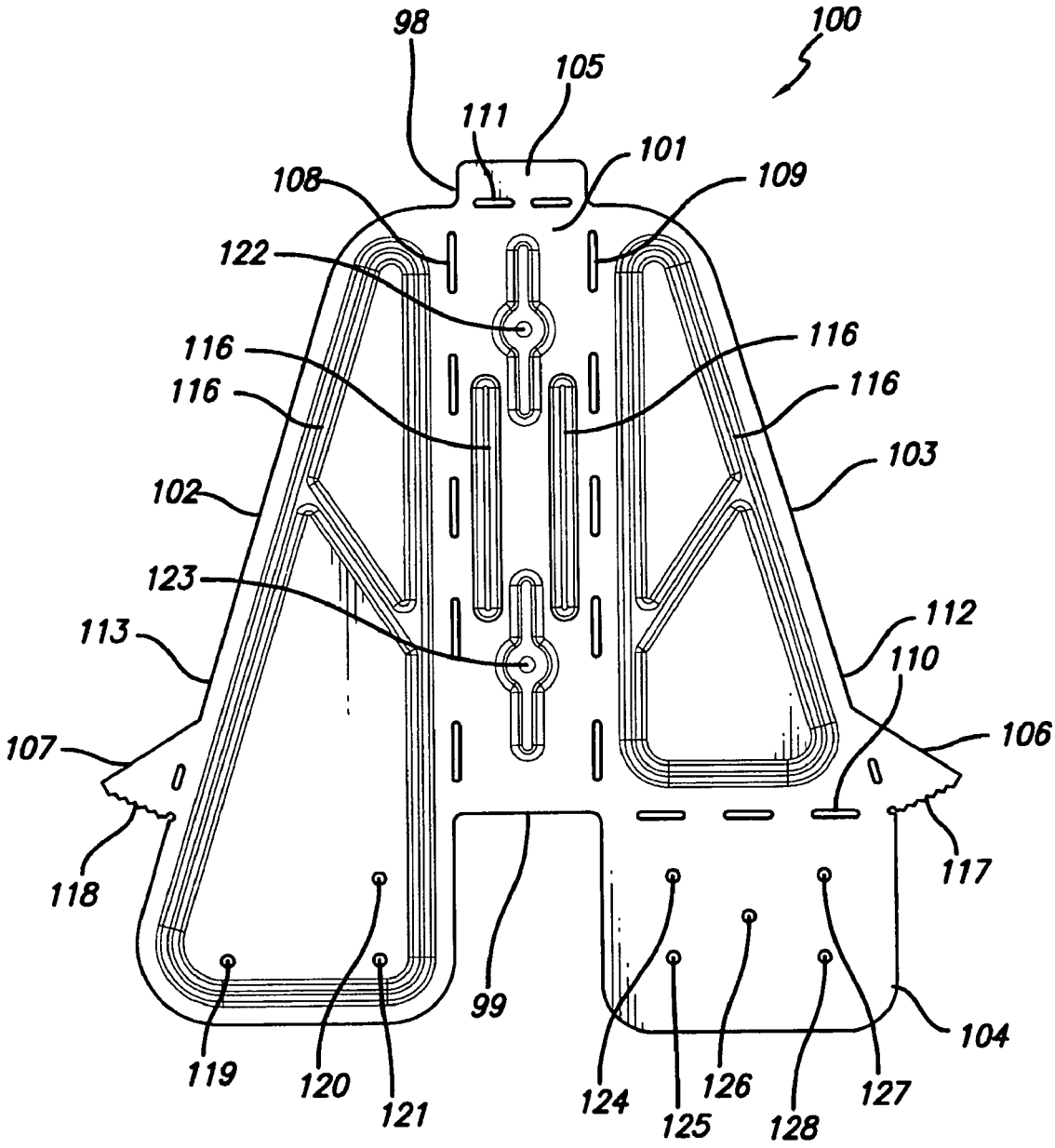
FIG. 9 is a top plan view of a blank utilized for forming a corner shelf bracket.
Figure 10:
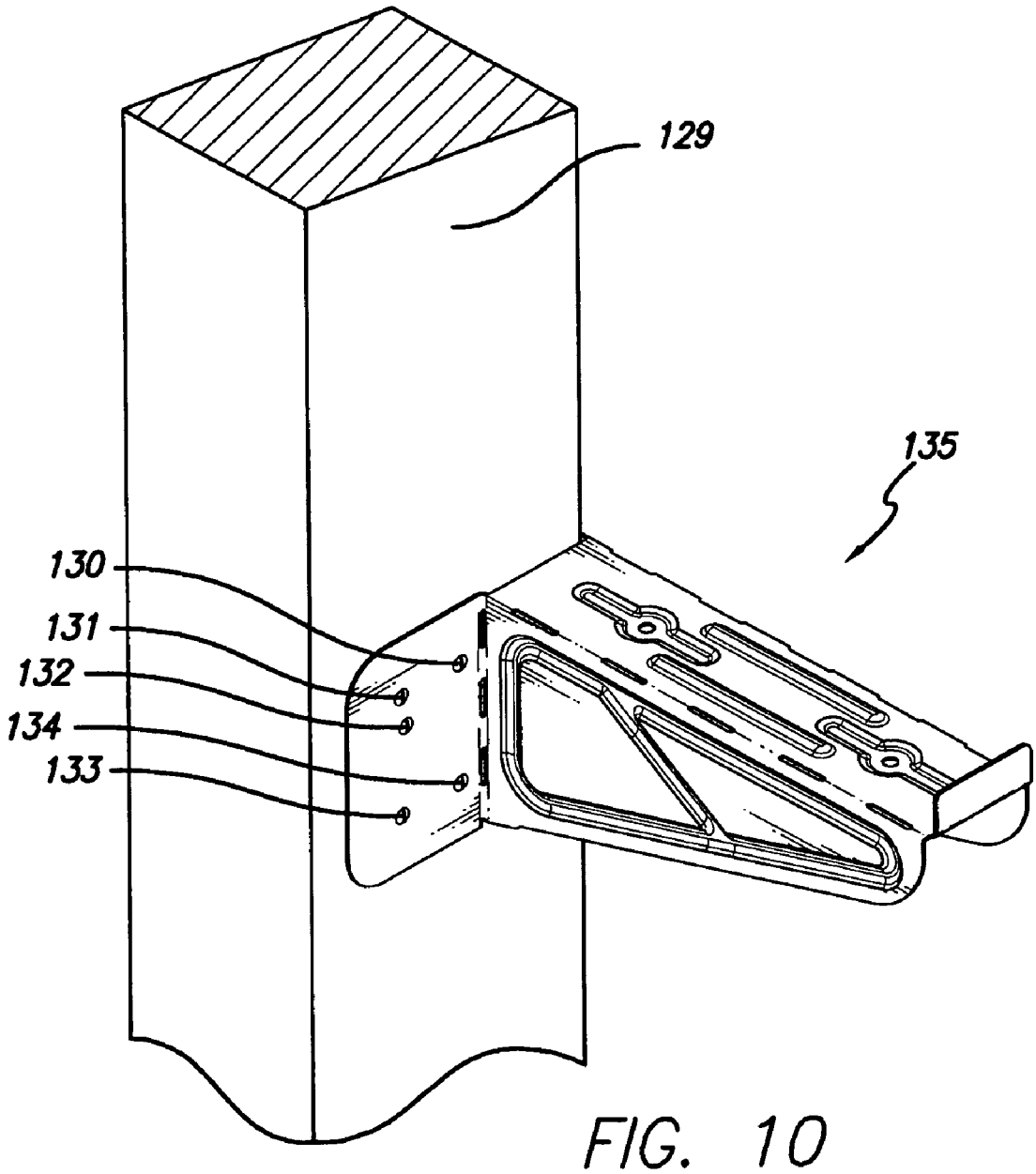
FIG. 10 is a perspective view of a corner shelf bracket formed from the blank depicted in FIG. 9, showing the corner shelf bracket attached to a support.

Referring now to FIGS. 9-10, shown therein is a blank 100, and a corner shelf bracket 135 constructed in accordance with the present invention. The blank 100, depicted in FIG. 9 and the corner shelf bracket 135, depicted in FIG. 10 are similar in construction and function to the shelf bracket 10 and 10*a*, and the blank 60 and 60*a* described above, except for the differences shown in FIG. 9-10 and described below. As described below the corner shelf bracket 135 is constructed so as to connect to approximately perpendicular faces of a corner stud support, rather than parallel faces in which the shelf brackets 10 and 10*a* attach.

FIG. 9 depicts a blank 100 which is formed into the corner shelf bracket 135 depicted in FIG. 10. The blank 100 is provided with a substantially triangular shape, however, it should be understood that the blank 100 can be provided with any shape so long as the blank 100 can be utilized as described herein. The blank 100, is shown with a ledge portion 101, the ledge portion 101 having a first end 99 and a second end 98, a first side portion 102, a second side portion 103, a third side portion 104, a lip portion 105, and stiffener portions 106 and 107. The blank 100 is preferably constructed of a single sheet of material. The blank 100 can be formed from any suitable process. However, it should be understood that the blank 100 can be constructed of multiple parts that have been connected together. For example, the blank 100 can be formed by stamping, laser cutting, water jet cutting, extrusion, molding or the like. The thickness, and/or construction of the material will vary based upon the desired use of the corner shelf bracket 135. For example, where the corner shelf bracket 135 will be utilized at an individual's home for supporting rather small loads, such as paint cans, the blank 100 can be constructed of a material such as 18-22 gauge steel. Thus, it should be understood that the weakened areas of the blank 100 can be bent using either the hands of the individual, a small hand-operated tool, such as a pair of pliers or a hammer, or perhaps a homeowner's shop vise rather than commercial bending equipment, such as a press brake.

In FIG. 9, the ledge portion 101, is shown connected to the first side portion 102, by stress line 108, the stress lines 108 forming a weakened area within the blank 100. The ledge portion 101 is also shown connected to the second side portion 103, by stress line 109, the stress line 109 forming a weakened area within the blank 100. The third side portion 104, is formed and separated from the second side portion 103 by stress line 110 extending from and along the first end 99 of the ledge portion, the stress line 110 forming a weakened area within the blank 100 to permit the third side portion to be manually bent approximately 90° relative to the second side portion 103 to permit the third side portion to be connected to a perpendicular face of a corner stud support when the blank 100 is converted into the corner shelf bracket 135. It should be noted that although the third side portion 104, is shown created within the second side portion 103, the third side portion 104 can be created within the first side portion 102 by forming a stress line (not shown) within the first side portion 102 extending from and along the first end 99 of the ledge portion. The lip portion 105, is shown connected to the ledge portion 101 by stress line 111, the stress line 111 forming a weakened area within the blank 100. In addition, the stiffener portion 106 is shown connected to the second side portion 103, by a stress line 112, the stress line 112 forming a weakened area within the blank 100. The stiffener portion 107 is shown connected to the first side portion 102, by a stress line 113, the stress line 113 forming a weakened area within the blank 100. Stiffener portion 106 and 107 have a connector portion 117 and 118, which allows the stiffener portion 106 and 107 to connect to the corner stud support for added stability, when the blank 100 is converted into the shelf bracket 135. A more detailed description of the connector portion 117 and 118 is found in FIGS. 9-11 and paragraphs [0035]-[0044] of the patent application identified by U.S. Ser. No. 11/827,337, filed on Jul. 11, 2007, which is hereby incorporated by reference. The stress lines 108-113 can be formed from any suitable process for weakening the blank 60*a* in these areas. For example, the stress lines 108-113 can be formed by a series of circular cut outs, slots, or laser cutline(s).

The blank 100 is also shown in FIG. 9 with a plurality of rib portions 116. The plurality of rib portions 116 are shown extending across or inside the first side portion 102, and the second side portion 103 and are also shown extending across or inside the ledge portion 101. The plurality of rib portions 116 provide additional strength to the side portions 102 and 103 when the blank 100 is formed into the shelf bracket 135 so that a thinner material can be used in forming blank 100. This reduces the cost of the blank 100. It should be noted that the blank 100 and the shelf bracket 135 can be provided with fewer rib portions or additional rib portions in each of the side portions 102 and 103 and the ledge portion 101 which can be either spaced apart, or contiguous for added strength when the blank 100 is converted into the corner shelf bracket 135.

As shown in FIG. 9, the blank 100 is also provided with a plurality of openings 119-128. Openings 119, 120 and 121 are depicted in the first side portion 102 of the blank 100. Openings 122 and 123 are depicted on the ledge portion 101. Openings 124-128 are depicted in the third side portion 104 of the blank 100. It should be noted that the blank 100 as shown in FIG. 9 and the corner shelf bracket 135 as shown in FIG. 10 can be provided with more or less openings. As depicted in FIG. 10 openings 119-121 and openings 124-128 are used to attach the corner shelf bracket 135 to a support 129 using fasteners 130-134, when the blank 100 is converted into the corner shelf bracket 135. Openings 122 and 123 are used to attach a load (not shown) to the corner shelf bracket 135, when the blank 100 is converted into the corner shelf bracket 135.

Referring now to FIG. 10, shown therein is the corner shelf bracket 135, shown attached to a support 129. Because the corner shelf bracket 135 and the blank 100 have identical features, those identical features will not be described hereinafter for purposes of brevity. The blank 100 is converted into the corner shelf bracket 135 by applying force along the stress lines previously described so as to convert the blank 100 into the corner shelf bracket 135 and attaching the shelf bracket 135 to the approximately perpendicular faces of the corner stud support as depicted in FIG. 10. Additionally, the corner shelf bracket 135 is shown attached to the support 129 by means of fasteners 130-134. Fasteners 130-134, can be any fastener such as a screw or nail which is sufficient to attach the corner shelf bracket 135 to the support 129. The support 129 can be any type of post, or vertical support capable of supporting the corner shelf bracket 135. For example, the support 129 can be two 2×4 studs positioned at a substantially 90° angle in the corners of barns garages, sheds or other structures where additional storage capacity is desirable. The corner shelf bracket 135 can support a load (not shown) which includes anything capable of being supported by the corner shelf bracket 135. Also, it is envisioned that a corner shelf bracket 135 would be used in combination with another corner shelf bracket 135 or with one or more of the shelf brackets 10 or 10*a*, for forming a shelving unit (not shown) to support a load.

It should be understood that the figures are not necessarily to scale and certain features and certain views of the figures may be shown exaggerated in scale or in schematic in the interest of clarity and conciseness. It will also be understood from the foregoing description that various modifications and changes may be made in the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an," and other singular terms are intended to include the plural forms thereof unless specifically excluded.

What is claimed is:

1. A blank for forming a corner shelf bracket having a ledge and a plurality of side members, the blank comprising:

a ledge portion having a first end and a second end;

a first side portion connected to the ledge portion by a first stress line forming weakened areas within the blank, whereby the first side portion extends along the ledge portion;

a second side portion connected to the ledge portion by a second stress line forming weakened areas within the blank, whereby the second side portion extends along the ledge portion and further extends a distance beyond the first end of the ledge portion;

a third side portion connected to the first side portion by a third stress line forming weakened areas within the blank, the third stress line extending along the first side portion substantially collinear with the first end of the ledge portion;

a plurality of stiffener portions with at least one stiffener portion extending from both the first side portion and the second side portion, whereby the stiffener portions are connected to the first side portion and the second side portion by a respective stiffener stress line;

a first connector portion connected to one of the plurality of stiffener portions, the first connector portion adapted to connect the stiffener portion to the support when the blank is converted into the corner shelf bracket; and a second connector portion connected to another one of the plurality of stiffener portions, the second connector portion adapted to connect the respective stiffener portion to the support when the blank is converted into the corner shelf bracket.

2. The blank of claim 1, further comprising a lip portion extending from the second end of the ledge portion of the blank.

3. The blank of claim 1, wherein the first connector portion and second connector portion include at least one tooth for connecting to the support.

4. The blank of claim 3, wherein the second and third side portions have a plurality of openings for permitting attachment of the corner shelf bracket to the support.

5. The blank of claim 3, wherein the ledge portion of the blank has a plurality of openings for permitting attachment to the support.

6. The blank of claim 5, further comprising a plurality of ribs with at least one rib positioned in the first and second side portions for strengthening the blank when the blank is converted into the corner shelf bracket.

7. The blank of claim 5, further comprising at least one rib positioned in the ledge portion for strengthening the blank when the blank is converted into the corner shelf bracket.

* * * * *